United States Patent [19]

Yamamoto et al.

[11] Patent Number: 4,823,159

[45] Date of Patent: Apr. 18, 1989

[54] IMAGE FORMING APPARATUS

[75] Inventors: Yasuyoshi Yamamoto; Masashi Ohashi, both of Tokyo; Tatsuya Shiratori, Yokohama; Michiro Koike, Kawasaki; Atsushi Kubota, Machida; Nobukazu Sasaki; Akiyoshi Kimura, both of Tokyo; Takashi Ozawa, Ichikawa; Toshirou Kasamura, Yokohama; Toshihiko Kusumoto, Tokyo, all of Japan

[73] Assignee: Canon Kabushiki Kaisha, Tokyo, Japan

[21] Appl. No.: 129,366

[22] Filed: Nov. 30, 1987

Related U.S. Application Data

[63] Continuation of Ser. No. 57,669, Jun. 2, 1987, abandoned, which is a continuation of Ser. No. 855,463, Apr. 24, 1986, abandoned.

[30] Foreign Application Priority Data

Apr. 25, 1985 [JP] Japan ..... 60-90308
Apr. 26, 1985 [JP] Japan ..... 60-90119

[51] Int. Cl.[4] ..... G03G 15/00

[52] U.S. Cl. ..... 355/3 SH; 355/14 SH; 271/249

[58] Field of Search ..... 355/3 SH, 3 R, 14 SH, 355/3 BE, 109; 271/249, 250, 252, 253, 254, 255, 227

[56] References Cited

U.S. PATENT DOCUMENTS

| | | | |
|---|---|---|---|
| 4,058,359 | 11/1977 | Urselmann | 355/109 |
| 4,187,024 | 2/1980 | Satomi et al. | 355/14 R |
| 4,260,242 | 4/1981 | Nishikawa | 355/14 TR |
| 4,281,244 | 7/1981 | Murata et al. | 250/255 |
| 4,334,759 | 6/1982 | Clausing | 355/3 SH |
| 4,397,538 | 8/1983 | Castelli et al. | 355/3 BE |
| 4,408,866 | 10/1983 | Gustafson | 355/3 SH X |
| 4,419,003 | 12/1983 | Fujie et al. | 355/3 SH X |
| 4,511,242 | 4/1985 | Ashbee et al. | 355/3 SH X |
| 4,519,700 | 5/1985 | Barker et al. | 355/3 SH |
| 4,607,942 | 8/1986 | Koyama et al. | 355/3 SH |
| 4,685,664 | 8/1987 | Petersdorf | 271/227 |

FOREIGN PATENT DOCUMENTS

| | | |
|---|---|---|
| 2810294 | 9/1978 | Fed. Rep. of Germany . |
| 2922977 | 12/1979 | Fed. Rep. of Germany . |
| 2924489 | 3/1980 | Fed. Rep. of Germany . |
| 9177237 | 10/1984 | Japan . |
| 60-14250 | 1/1985 | Japan . |
| 2141695 | 1/1985 | United Kingdom . |

*Primary Examiner*—A. C. Prescott

*Attorney, Agent, or Firm*—Fitzpatrick, Cella, Harper & Scinto

[57] ABSTRACT

An image forming apparatus includes an image forming station for forming an image on a sheet; a rotatable member for transferring the sheet in a first direction toward the image forming station; supporting device for supporting the rotatable member for displacement in a second direction which crosses the first direction; driving device for displacing the rotatable member in the second direction to correct deviation of the sheet in the second direction; and inlet guide for guiding the sheet to the rotatable member, the guide being displaceable in the second direction together with the rotatable member.

7 Claims, 11 Drawing Sheets

IMAGE FORMING APPARATUS

This application is a continuation of application Ser. No. 057,669 filed June 2, 1987, now abandoned, which was a continuation of application Ser. No. 855,463, filed Apr. 24, 1986, now abandoned.

FIELD OF THE INVENTION AND RELATED ART

The present invention relates to an image forming apparatus such as an electrophotographic copying machine, micro device and recording apparatus, more particularly to the image forming apparatus provided with means for correcting lateral deviation of the sheet material on which an image is recorded.

In the following description, a copying machine is taken as an example of the image forming apparatus, but the present invention is not limited to this as will be understood from the following description.

Recently, some electrophotographic copying machines have been provided with duplicate copying and/or a superimposing copying function and contain the corresponding sheet conveyance passage. In those types of apparatus, the recording sheet such as a transfer sheet, is obliquely transported so that satisfactory sheet transportation is not assured. The reasons for this are (1) a couple of transporting rollers forming a nip can be contacted under a pressure which is not uniform along the length of the nip; (2) a transporting roller is slightly deformed in conical shape or the like due to unavoidable error in the manufacturing thereof; (3) one of a couple of rollers has a contaminated surface; and (4) the axis of the roller couple is not correctly perpendicular to the direction of transportation of the transfer sheet. In order to solve this problem, it is considered that a couple of lateral deviation correcting rollers is used. In this case, a sufficient amount of loop of the sheet is formed at the inlet side of the lateral registration rollers in order to remove the inclination of the sheet, in order to introduce the leading edge of the sheet into the nip of the couple of lateral registration rollers and in order to provide room for lateral movement of the sheet, thus avoiding possible lateral tension which may otherwise be caused in the sheet between the lateral deviation correcting roller couple and the upstream transportation roller couple. Usually, there are guiding plates at the inlet side of the lateral deviation correcting roller couple. Therefore, the loop of the sheet is contacted to the guiding plate. When the lateral registration roller for the correction of the lateral deviation starts moving, there occurs a friction between the guide plate and the sheet. When an edge of the guiding plate which is formed by a steel plate as contacted, the sheet may be damaged, and paper dust is produced which may be deposited on the surface of the rollers. Further, in the case where the guide plate is fixed on the main frame of the apparatus, the guide plate obstructs disposal of a jammed sheet upon occurrence of the jam at the lateral registration rollers so that it is difficult to remove the jammed sheet adjacent the nip.

In the apparatus described above, when a manual feeding tray is used to allow the operator to feed a sheet manually, the sheet has to be aligned with the feeding position in the direction perpendicular to the transportation of the transfer sheet with cumbersome adjustment. If the sheet is manually fed by the manual feeding tray, the transfer sheet tends to deviate laterally if the sheet is inserted without greatest care.

Additionally, since the lateral registration roller has to be disposed in the machine in addition to the registration roller, the apparatus becomes complicated and bulky.

SUMMARY OF THE INVENTION

Accordingly, it is a principal object of the present invention to provide an image forming apparatus wherein the load caused by the contact between the guide plate and the sheet is reduced to permit smooth lateral movement of the sheet.

It is another object of the present invention to provide an image forming apparatus provided with means for correcting the lateral deviation of the sheet, wherein jammed paper can be easily removed.

According to an embodiment of the present invention, the image forming apparatus is provided with means for correcting the lateral deviation of the sheet including lateral registration rollers for displacing the sheet in the direction perpendicular to the direction of the sheet transportation, wherein the correcting means is provided with an inlet guide for guiding the sheet to the lateral registration roller, and the inlet guide is movable laterally in association with the lateral registration roller, whereby there is no friction caused between the sheet and the guide when the lateral registration roller displaces, so that the damage to the sheet material or the like can be prevented.

Further, according to another embodiment of the present invention, the guide is made openable so as to accomplish easy handling of the jammed sheet.

According to another embodiment of the present invention, an image forming apparatus provided with registration rollers for starting transportation of the sheet material with a timed relation with the image on the image bearing member so as to align them, uses this registration roller as a means for aligning the sheet in the lateral direction by making the couple of registration rollers in its longitudinal direction. By this, the entire structure of the apparatus is simplified, and the size thereof can be reduced. For example, a cumbersome positional adjustment of the sheet feeding cassette can be omitted. Furthermore, upon manual sheet feeding operation, the sheet can be manually inserted without paying great attention to its lateral position.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
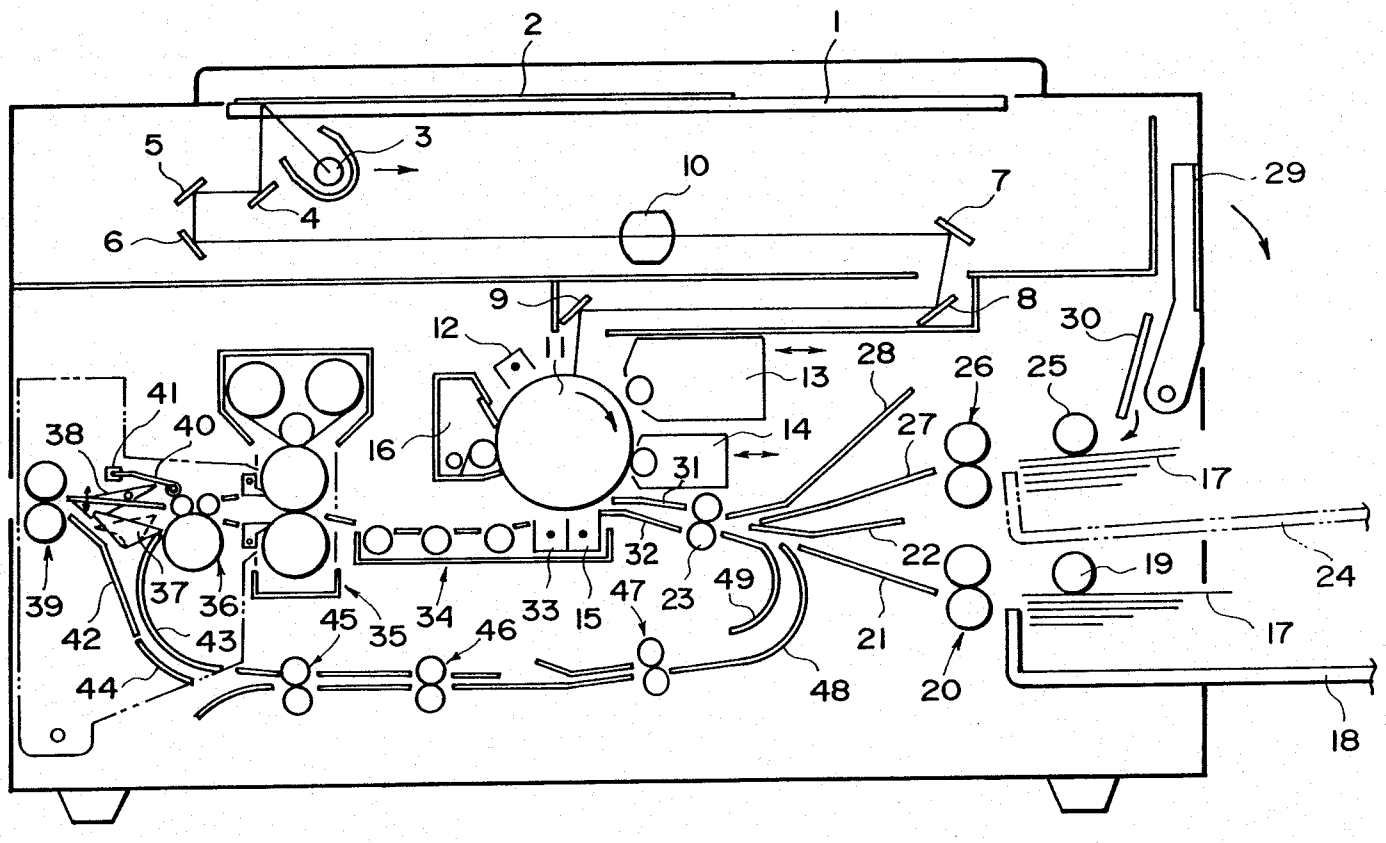
FIG. 1 is a sectional view of a copying apparatus to which the present invention is applicable.

Referring to FIG. 1, there is shown an image forming apparatus to which the present invention is applicable.

In this apparatus, an original to be copied 2 is placed on an original supporting glass 1 and is illuminated by a lamp 3. The light image thereof is directed to a surface of a photosensitive drum 11 by way of an optical system constituted by reflecting mirrors 4, 5, 6, 7, 8 and 9 and a lens 10. The lamp 3 and mirrors 4, 5 and 6 scan the original 2 in a direction indicated by an arrow at a predetermined speed. On the other hand, the photosensitive drum 11 is uniformly charged by a charger 12 while it is rotating in a direction indicated by an arrow. Thus, an electrostatic latent image corresponding to the original image is gradually formed on the drum surface. Adjacent to the photosensitive drum 11, a color developing device 13 containing color toner (red, blue or the like) and a black developing device 14 containing black toner are provided. Those developing devices are movable in the directions indicated by arrows so as to selectively develop the electrostatic latent image on the drum 11 when it is located adjacent thereto. In the state shown in this Figure, the color developing device 13 is away from the drum, while the black developing device 14 is disposed adjacent to the photosensitive drum 11, so that a black image is formed on the drum 11. The image is transferred onto a transfer material by a transfer charger 15. Thereafter, the surface of the photosensitive drum 11 reaches a cleaner 16, where the remaining toner is removed from the surface of the photosensitive drum 11, so that it is prepared for the next image formation.

The movement of the transfer material or sheet 17 will be described. The transfer sheet 17 is fed into the copying apparatus in one of plural modes. In the first mode, the transfer sheet is contained in a cassette 18 and is fed to a roller couple 20 by a pick-up roller 19. The roller couple 20 serves, when plural transfer sheets are fed out of the cassette, to separate the topmost sheet from the rest and to feed it into the apparatus. The sheet discharged from the roller couple 20 is advanced to a registration roller couple 23, while being guided by guiding plates 21 and 22. In the second mode, the transfer sheet is contained in a cassette 24 and fed out thereof by a pick-up roller 25 to a roller couple 26. The roller couple 26 has the same function as the roller couple 20 described above. The transfer sheet 17 is advanced to the same registration roller couple 23, while being guided by guiding plates 27 and 28. In the third mode, which is a so-called manual feeding mode, a manual feeding tray 29 is rotated in a direction of an arrow, and the transfer sheet is placed on a plate 30 and the manual feeding tray 29, whereby the transfer sheet 17 is transported to the registration roller couple 23 in the manner similar to the case of the first mode.

The registration roller couple 23 starts rotating in such a timed relation with the developed image on the photosensitive drum 11 that they are aligned. By the rotation of the registration roller couple 23, the transfer sheet is advanced toward the surface of the photosensitive drum 11 while being guided by a top guide 31 and a bottom guide 32. As described in the foregoing, the image on the photosensitive drum surface is transferred onto the transfer sheet 17 by the transfer charger 15 and then separated from the surface of the photosensitive drum 11 by a separating charger 33. Then, the transfer sheet is conveyed through the passage 34 to a fixing device 35, where the image on the transfer sheet 17 is fixed into a permanent image. Subsequently, the transfer sheet 17 is transported to a first discharging roller 36. Thereafter, the transfer sheet is advanced to a second discharging roller 39 through a first flapper 37 and a second flap 38, and then it is discharged out. In this figure, the second flapper 38 takes such a position as to block the transfer sheet passage. However, the second flapper 38 is of light material and is rotatable in the direction of an arrow, so that when the transfer sheet 17 passes, it is raised by the leading edge of the transfer sheet, and therefore, it does not obstruct passage of the transfer sheet 17.

In this apparatus, other ways of transportation is possible in addition to the basic transportation described above.

One of them is for duplicate copying wherein images are formed on both sides of the sheet. In this mode, the transportation of the sheet is similar to the above-described basic transportation when the image is formed on the first side of the transfer sheet, and it is transported to the second discharging roller 39. The second discharging roller 39 discharges the transfer sheet out of the apparatus to a partial extent. More particularly, when the duplicate copying mode is selected, a detecting arm 40 and a photosensor 41 detect the trailing edge of the transfer sheet, and after the trailing edge of the sheet passes by the first flapper 38, the second discharging roller 39 starts to rotate in the opposite direction without discharging it completely. By this, the transfer sheet is fed into the copying apparatus again with its trailing edge leading. The transfer sheet is then to a roller couple 45 by way of the left side inclined surfaces of the first and second flappers 37 and 38, and guiding plates 42, 43 and 44. Thereafter, the transfer sheet reaches through a roller couple 46 to a lateral registration roller couple 47, which is at rest at this time. The roller couples 45 and 46 stop after the transfer sheet completely abuts the lateral registration roller 47. The transfer sheet is waiting there for the image formation on the other side to start. When an instruction signal is produced for the image formation on the second side, the lateral registration roller couple 47 starts rotating to advance the transfer sheet to the registration roller couple 23 by way of guiding plates 48 and 49. Prior to the transfer sheet reaching the registration roller couple 23, a lateral side edge of the transfer sheet is detected by an unshown photosensor. In response to the detection, the lateral registration roller couple shifts in the lateral direction, that is, the direction substantially perpendicular to the direction of movement of the transfer sheet, more particularly, the direction perpendicular to the sheet of the drawing of FIG. 1, so that the lateral position of the sheet is controlled to be the same as in the first side copy. The operations after the transfer sheet reaches the registration roller is similar to the operation in the above-described basic mode. The transfer sheet now having received the image on the second side is discharged out by the second discharging roller 39. In another mode, two or more image forming operations are performed on the same side of the transfer sheet. In this mode, the operations are the same as in the basic mode in the first image formation, with the exception that the first flapper 37 takes the position shown by broken lines, whereby the transfer sheet discharged from the first discharging roller 36 is guided by the right side inclined surface of the first flapper and the guide plate 43, so that it is directly transported to the lateral registration roller couple 47. The operations thereafter are similar to the case of the duplicate copying operation. Thus, the transfer sheet receives the second image on the same side as the first image, and it is discharged out by the second discharging roller 39. The first flapper 37 returns to the solid line position at the time when the transfer sheet is fed to the lateral registration roller couple 47 after the first image formation, so as to be prepared for the control of the transfer sheet passage after the second image formation.

Next, the lateral registration roller will be described in detail which does not incorporate the present invention so that the problem discovered and solved by the present invention is understood. The lateral registration roller is effective to correct the lateral position of the sheet which has been subjected once to a copying operation for the purpose of the duplicate copy and the superimposed copy, and is effective to correct the lateral position of the sheet, that is, in the direction perpendicular to the transportation of the sheet.

The sheet is transported by the transporting rollers 45 and 46 toward the nip formed between the rollers of the lateral registration roller couple 47. At this time, the lateral registration roller does not rotate so that a loop of the sheet is formed. After a proper amount of the loop is formed, the transporting rollers 45 and 46 stop. The formation of the loop is intended to provide room for the lateral movement of the sheet so that the sheet can afford to move laterally. Then, the lateral registration roller couple starts to rotate to grip the sheet. After the registration roller couple 47 grips sufficiently the sheet, the lateral registration roller couple 47 displaces in the lateral direction to correct the lateral position of the sheet. During this displacement, the lateral registration roller couple continues rotating to transport it. By this series of operations, the sheet is moved to a predetermined correct position, so that the second image is formed in correct alignment with the first copy, so that correctly aligned superimposed and duplex copy can be provided.

This structure is more advantageous than a prior structure wherein the sheet is abutted to a lateral reference guide using an inclined roller which advances the sheet inclinedly, in that the lateral deviation of the sheet can be corrected in a short passage so that the size of the apparatus can be reduced.

However, the inventors have found problems with this structure. This structure requires the formation of a sufficient amount of the loop or slack of the sheet at the inlet side of the lateral registration roller in order to correct the inclined transportation of the sheet and to assure that the leading edge of the sheet is gripped by the lateral registration roller couple and also in order to allow the sheet to move in the lateral direction.

Figure 2:
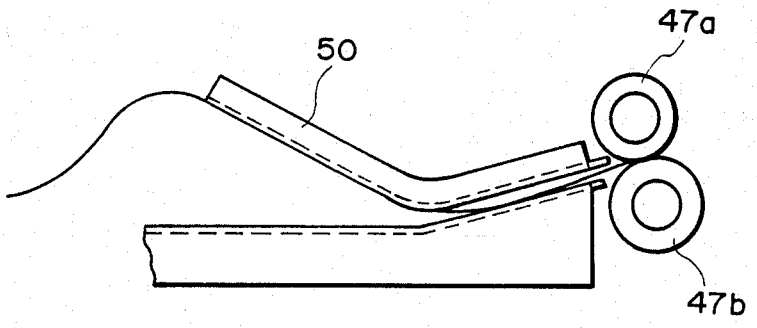
FIG. 2 is a sectional view illustrating formation of the loop at the inlet side of the lateral registration roller couple.

As shown in FIG. 2, when the loop is formed, the sheet is contacted to a top inlet guide plate 50 fixed to the frame of the apparatus. When the lateral registration roller couple 47 moves for the purpose of the lateral position correction, the sheet is enforced to friction with the top guide plate 50. The sheet rubs against an edge of the guide plate made of steel, for example, with the result that the sheet is damaged or that paper dust is produced and deposited on the rollers therearound.

Further, since the top guide plate 50 is fixed on the main frame of the apparatus, the sheet, if jammed, is difficult to moved completely.

Further, when the manual feed tray 29 is used, the lateral position of the sheet can be correctly adjusted by cumbersome adjusting operations.

When the sheet is fed manually, the lateral position is deviated if the insertion of the transfer sheet is performed without greatest care.

Additionally, the lateral registration roller couple 47 has to be disposed in the apparatus, with the result that the apparatus is complicated, and the size is still large.

Figure 3:
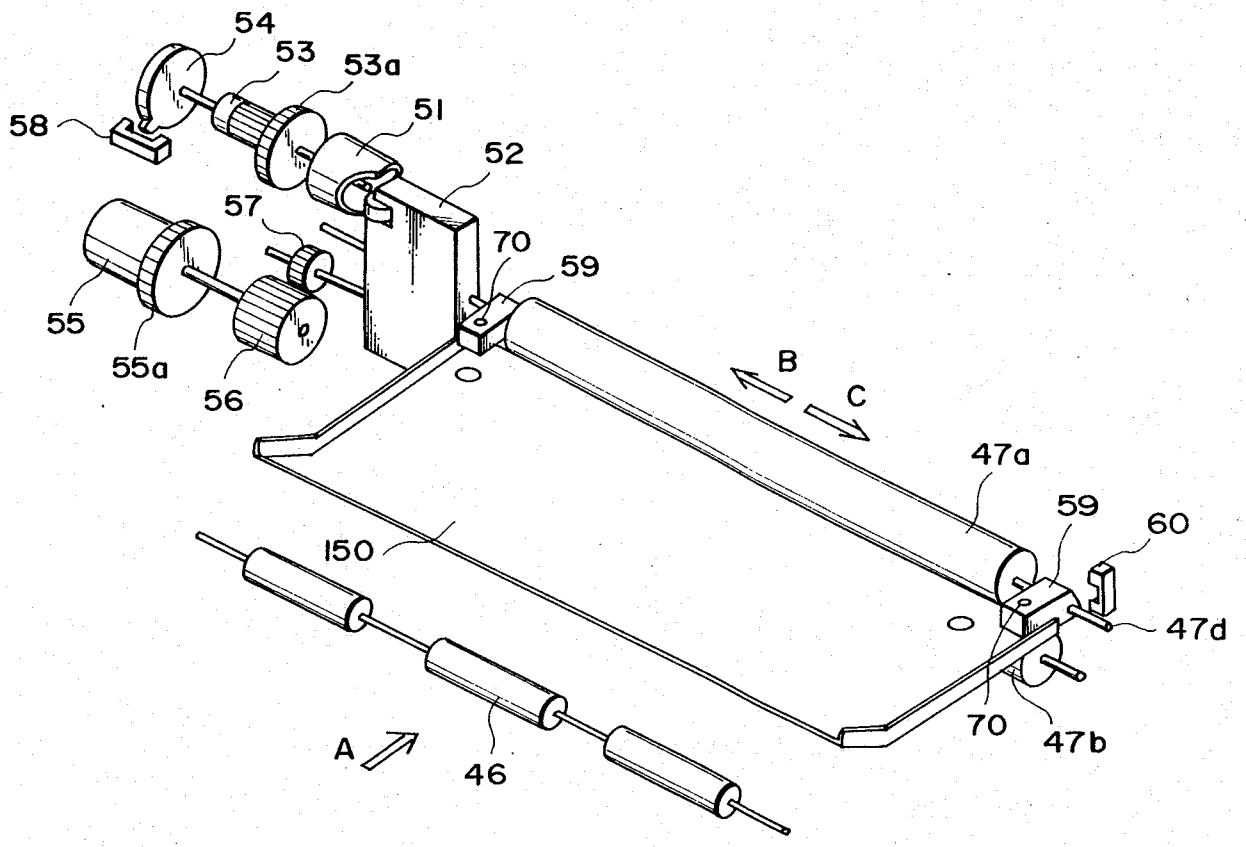
FIG. 3 is a perspective view of a part of the apparatus according to an embodiment of the present invention.
Figure 4:
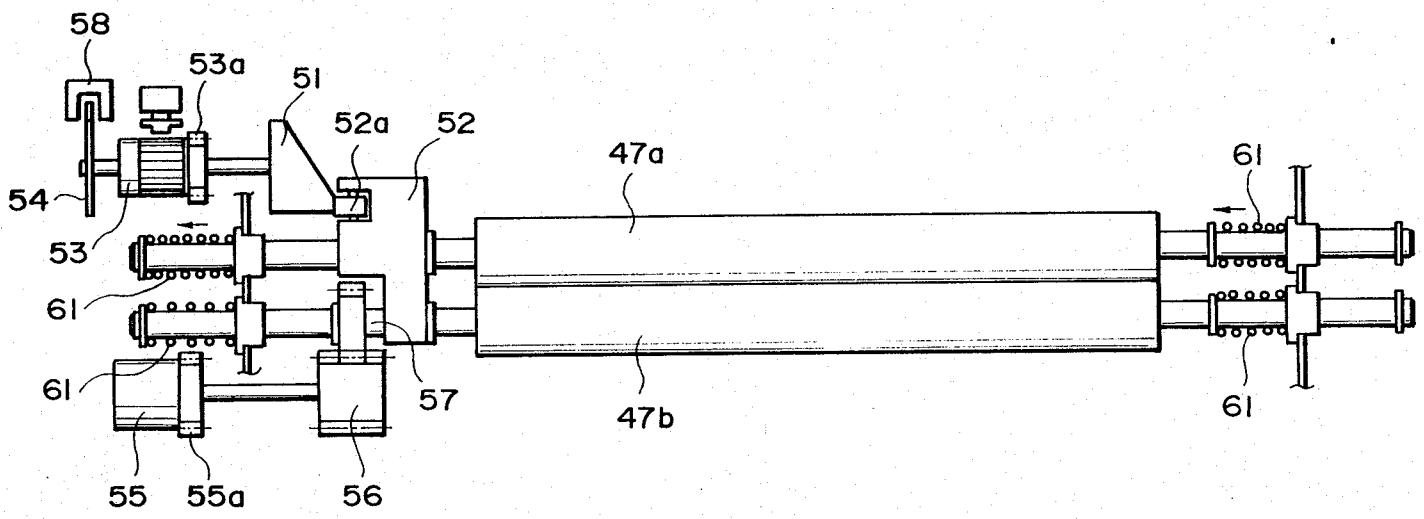
FIG. 4 is a front view of the part shown in FIG. 3.

FIG. 3 is a perspective view of the mechanism around the lateral deviation correcting device, and FIG. 4 is a front view thereof.

This device includes a cam which is effective to provide the lateral displacement of the lateral registration roller couple 47 constituted by rollers 47*a* and 47*b*. The registration roller couple is driven by an input gear 55*a* controlled by an electromagnetic clutch 55, wherein the rotation the input gear 55*a* is transmitted through the gears 56 and 57 to the lower roller 47*b* of the lateral registration roller couple to transport the sheet.

In operation, the transfer sheet is conveyed in a direction of an arrow A and is detected by an unshown sensor at a position immediately before the lateral registration roller couple. The transportation roller 47 continues advancing the sheet in a predetermined period from the detection of the sheet by the sensor. At this time, the lateral registration roller couple 47 does not rotate so that a proper amount of loop of the sheet is formed between the lateral registration roller couple 47 and the transporting roller 46 by the transporting roller 46 continuing and then stopping its rotation. Then, the electromagnetic clutch 55 is engaged so that the input gear 55*a* starts to rotate, rotating the lower roller 47*b*. Simultaneously therewith, a spring clutch 53 is engaged to transmit the rotation of the input gear 53*a* to the cam 51. Cam 51 moves in a direction of an arrow C a lateral registration roller block 52 which supports the upper and lower lateral registration rollers 47*a* and 47*b*, whereby those registration rollers are laterally shifted. When a lateral edge of the sheet reaches a predetermined position by a photosensor 60 fixed on a frame of the apparatus, the sheet blocks the light to the photosensor 60, in response to which a signal is produced and is transmitted to an unshown controller so as to inform the completion of the lateral registration. By this, the lateral displacement of the registration roller couple stops, and the electromagnetic clutch 55 is kept engaged until the trailing edge of the sheet is away from the lateral registration roller couple 47.

There are provided four compression coil springs 61 to urge the rollers in a direction indicated by an arrow B. After the cam 51 rotates to such an extent that the lateral registration roller couple 47 reaches the limit in the direction of the arrow C, the inclination of the cam 51 is such that the lateral registration roller couple 47 displaces back in the direction of the arrow B with the aid of the function of the completion springs. Thus, the coil springs are effective to contact the roller couple 47 to the cam surface so that the roller couple 47 follows the inclination of the cam surface.

When the roller couple 47 moves to a home position, that is, a predetermined position where it is located when waiting for the paper to come, a light blocking plate 54 blocks the light to the photosensor 58, the blocking plate 54 being mounted coaxially with the spring clutch 53. In response to the signal from the photosensor 58, the spring clutch 53 is disengaged so as to stop the rotation of the cam plate 51, with the result that the lateral displacement of the registration roller couple 47 stops.

At the inlet side of the lateral registration roller couple, there is provided a top guide plate 150. To the top guide plate 150, blocks 59 are mounted adjacent opposite lateral sides at such an end in the direction of the sheet transportation that is near the lateral registration roller couple. The blocks 59 are engaged with an upper roller shaft **47*d* and are fixed to the top guide plate 150 by screws 70**.

Figure 5:
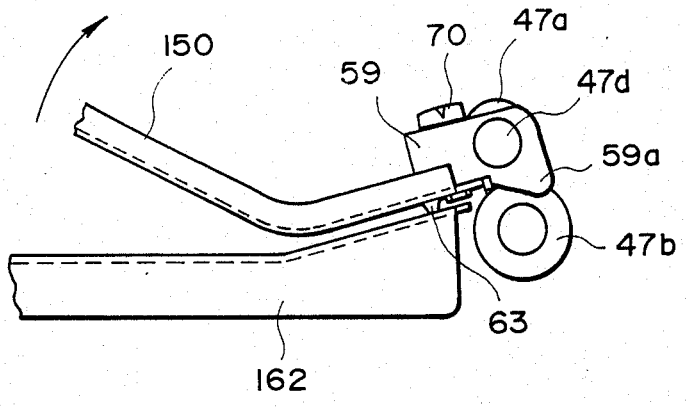
FIGS. 5 and 6 are side views illustrating opening of a top guide plate.

FIG. 5 is a side view of this mechanism. As will be best seen, the top guide plate 150 is rotatable about the axis of the upper roller **47*a*** so as to open the passage of the transfer sheet.

Projections 63 are formed on the bottom surface of the top guide plate 150 so as to keep a clearance between the bottom guide 162 and itself. The sheet passes through this clearance. Since the block 59 is engaged with the upper roller **47*a* adjacent opposite ends thereof, it moves together with the lateral displacement of the upper roller 47*a***.

Figure 6:
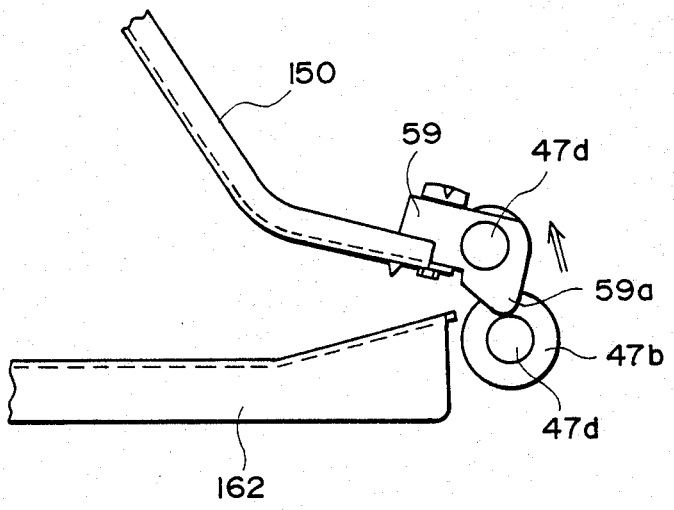

The block 59 has a projection **59*a*. The projection 59*a*, when the upper guide plate 150 rotates, contacts the shaft 47*d* of the lower roller 47*b* as shown in FIG. 6. Therefore, if the lower roller 47*b* is stationarily mounted at a fixed position on the frame of the apparatus, and if the upper roller 47*a* is movable away from the lower roller 47*b*, the projection 59*a* of the block 59 is effective to raise the upper roller 47*a* as indicated by an arrow in FIG. 6**, so as to open or ease the nip therebetween. By this, the disposal of the jam is made easier.

Figure 7:
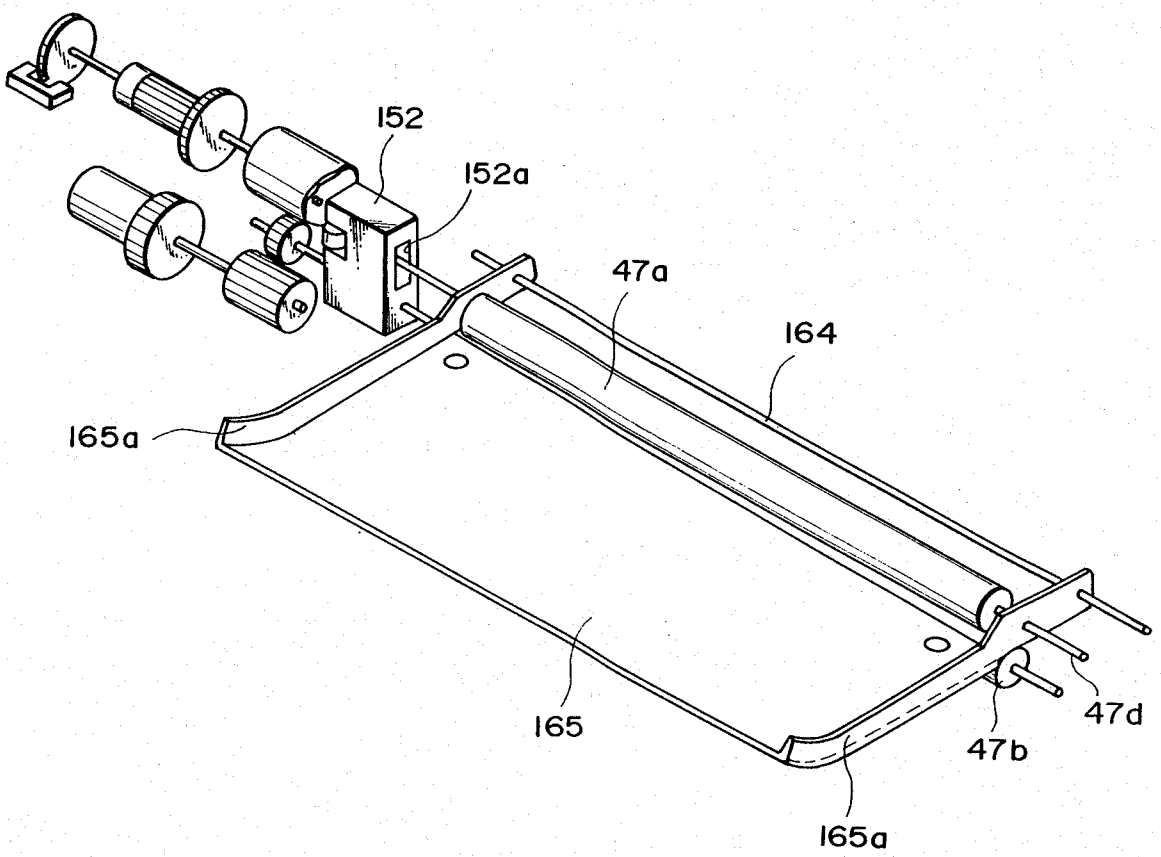
FIG. 7 is a perspective view of a part of an image forming apparatus according to another embodiment.

FIG. 7 is a perspective view of an apparatus according to another embodiment. In this embodiment, the top guide plate 165 has side ribs **165*a* through which holes are formed to allow the shaft 47*d* of the upper roller 47*a* to be inserted. A shaft 164 is fixed on the frame of the apparatus, and the shaft 164 is also inserted through other holes of the ribs 165*a*. The lateral registration block 152 has a guiding slot 152*a* in which the shaft 47*d*** is inserted.

Figure 8:
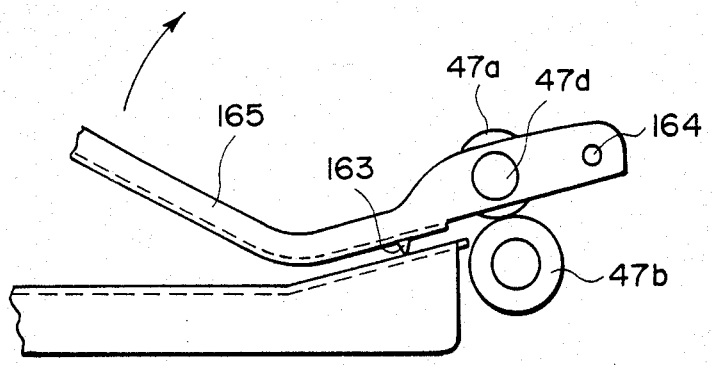
FIG. 8 is a front view according to another embodiment.
Figure 9:
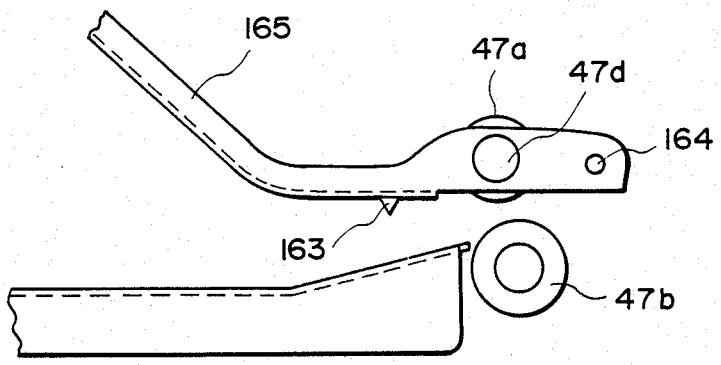
FIG. 9 is a front view illustrating opening of a top guide.

FIG. 8 is a side view of the mechanism of FIG. 7. In this embodiment, the top guide plate 165 is rotatable about an axis of the shaft 164. Since the top guide plate 165 supports the upper roller **47*a* in this embodiment, the top guide plate 165 opens as shown in FIG. 7 by rotating it in the direction indicated by an arrow as in the previous embodiment, and simultaneously, the upper or lower roller is away relative to the other so as to facilitate the jam disposal. When the roller couple 47 displaces laterally for the purpose of lateral deviation correction, the top guide plate 165 moves together with the roller couple 47. The shaft 164 slides with respect to the top guide plate 165 so as not to obstruct the displacement of the roller couple 47**. As described, in the automatic duplex and/or superimposed copying apparatus, the lateral registration mechanism is provided with the inlet guide which is movable integrally with the lateral registration roller couple, and which is rotatable about an axis of the shaft for the roller couple or another axis, according to this invention. Therefore, the frictional resistance between the sheet and the guide plate is reduced so as to allow the smooth transportation or displacement of the sheet. In addition, since the guide plate is openable, a jam is easily disposed of.

Figure 10:
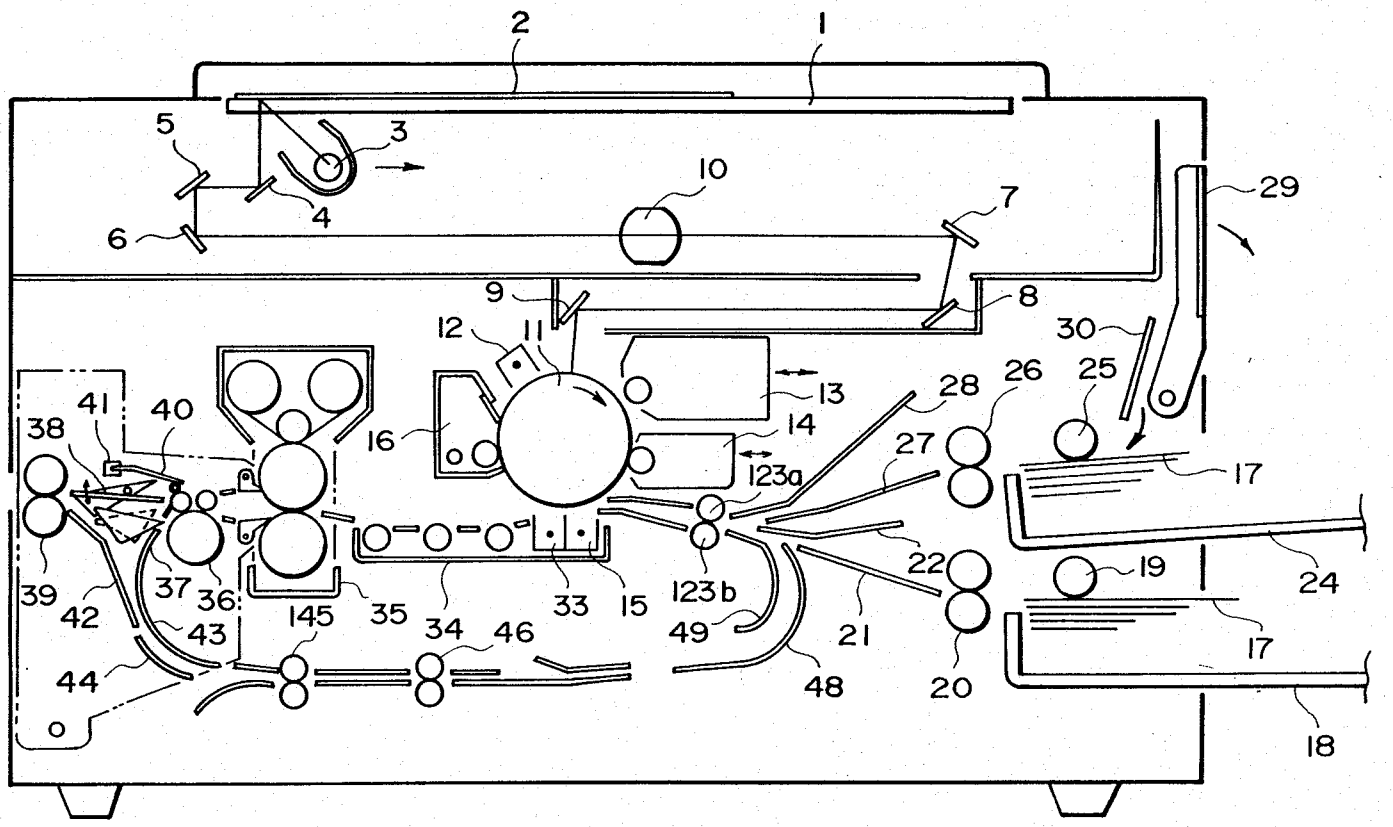
FIG. 10 is a sectional view of an image forming apparatus according to a further embodiment of the present invention.

FIG. 10 shows a further embodiment of the present invention, wherein the registration roller couple 123 is constituted by rollers **123*a* and 123*b*. It will be remembered that in the foregoing embodiment, the registration roller couple disposed at this position functions to register the transfer sheet with the image on the photosensitive member in the direction of the transportation of the sheet only. In this embodiment, however, the registration rollers 123*a* and 123*b*** are rotatable to transport the transfer sheet and are displaceable as a whole in the direction perpendicular to the transportation of the sheet.

Figure 11:
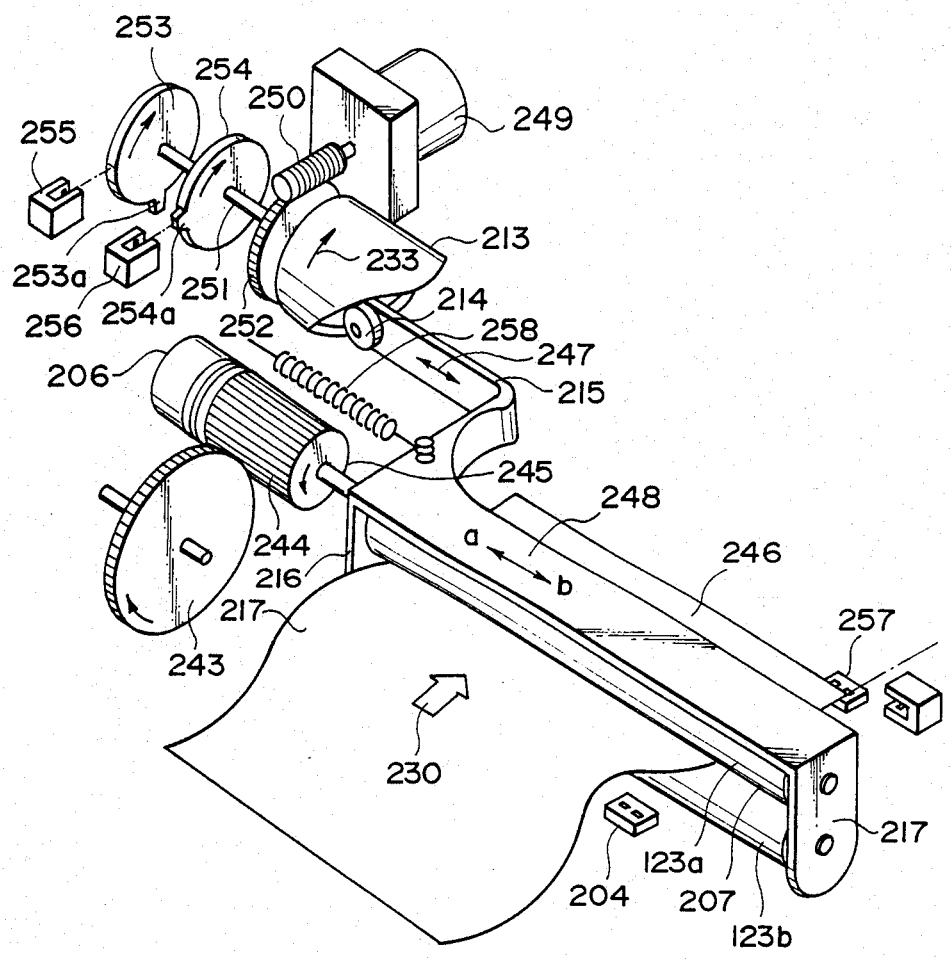
FIG. 11 is a perspective view illustrating a driving mechanism for a couple of registration rollers.

FIG. 11 shows the mechanism of the registration roller couple 123. A gear 244 is rotatably mounted to a shaft 245 of the roller **123*a*. When a clutch 206 is engaged, the driving force from an unshown driving source is transmitted through the gear 245 to the roller 123*a*. The rollers 123*a* and 123*b* are supported by a frame 246 in the manner that the shafts thereof extend perpendicularly to the sheet transporting direction, the shafts thereof being rotatably supported by arms 216 and 217. The frame 246 is connected with a bar 215 extending in the direction perpendicular to the sheet transporting direction. The free end of the bar 215 is formed into a fork having fingers, between which a roller 214 is rotatably supported. The roller 214 is engaged to a rotatable inclined plate 213 which is rotatable in the direction indicated by an arrow 233, so that the roller 214 follows the inclined surface 213. When the inclined plate 213 rotates in the direction of the arrow 233, the bar 215 and the frame 246 displaces or shifts reciprocally in the directions indicated by arrows 247 and 248, which are perpendicular to the sheet transporting direction. The amount of the lateral displacement of the bar 215 is determined by the angular position of the inclined rotatable plate 213. When the frame 246 moves horizontally in the direction of the arrow 248, the gear 243 is kept meshed with the gear 244 which is thick or long in the direction of its axis whereby the meshing engagement therebetween is maintained by the sliding movement therebetween. Therefore, the rollers 123*a* and 123*b* continue rotating while they are shifting in the longitudinal direction. The inclined plate 213 is rotated through the gear 252 fixed on the shaft 251 of the inclined rotatable plate 213, through a gear 250 from a motor 249. On the shaft 251, disks 253 and 254 are fixed. The disks 253 and 254 have the respective projections 253*a* and 254*a*, which are sensed by sensors 255 and 256, respectively. In response to the detections by the sensors 255 and 256, the motor 249 is on-off controlled to control the angular or rotational position of the inclined plate 213. The sensor 255 detects that the inclined plate 213 reaches the lower dead point, and the sensor 256 detects that it reaches its home position. A spring 258 has an end engaged to the frame 246 so as to assure the engagement between the inclined rotatable plate 213 and the roller 214**. The operations of this mechanism will be described when the transfer sheet coming to this mechanism with its lateral side displaced is corrected in its lateral position.

The leading edge of the transfer sheet fed from the feeding cassette or from the manual feeding tray abuts the nip formed between the registration rollers 123*a* and 123*b*, which are not rotating at this time. The transfer sheet continues to be advanced in the direction of an arrow 230 until a proper amount of loop is formed between the registration roller couple and the sheet feeding station. By this, the leading edge of the transfer sheet is aligned with the nip 207 between the registration rollers 123*a* and 123*b*. Then, the registration rollers 123*a* and 123*b* rotate by a slight but sufficient amount to grip the leading edge portion of the transfer sheet therebetween. After this, the loop of the transfer sheet still remains between the registration roller couple and the sheet feeding station. Thereafter, the motor 249 of FIG. 11 starts to rotate to laterally shift or displace the rollers 123*a* and 123*b* as a whole. The lateral shifting continues until a lateral edge of the transfer sheet reaches the reference position defined by the sensor 257. Then, the registration roller 123*a* starts to rotate at a timing with which the transfer sheet is aligned with the image formed on the photosensitive member.

Also, when the transfer sheet conveyed to the registration roller couple for the second time for the purpose of superimposed copying and the duplex copying, the loop is formed between the registration roller couple and the transporting roller 46, and the lateral deviation of the sheet is corrected by the similar operation.

As shown in FIG. 11, there is provided a sensor 204 for sensing the leading edge of the transfer sheet. The transportation of the transfer sheet is stopped a predetermined period after the leading edge of the transfer sheet is detected, so that a constant amount of loop is formed.

Figure 12:
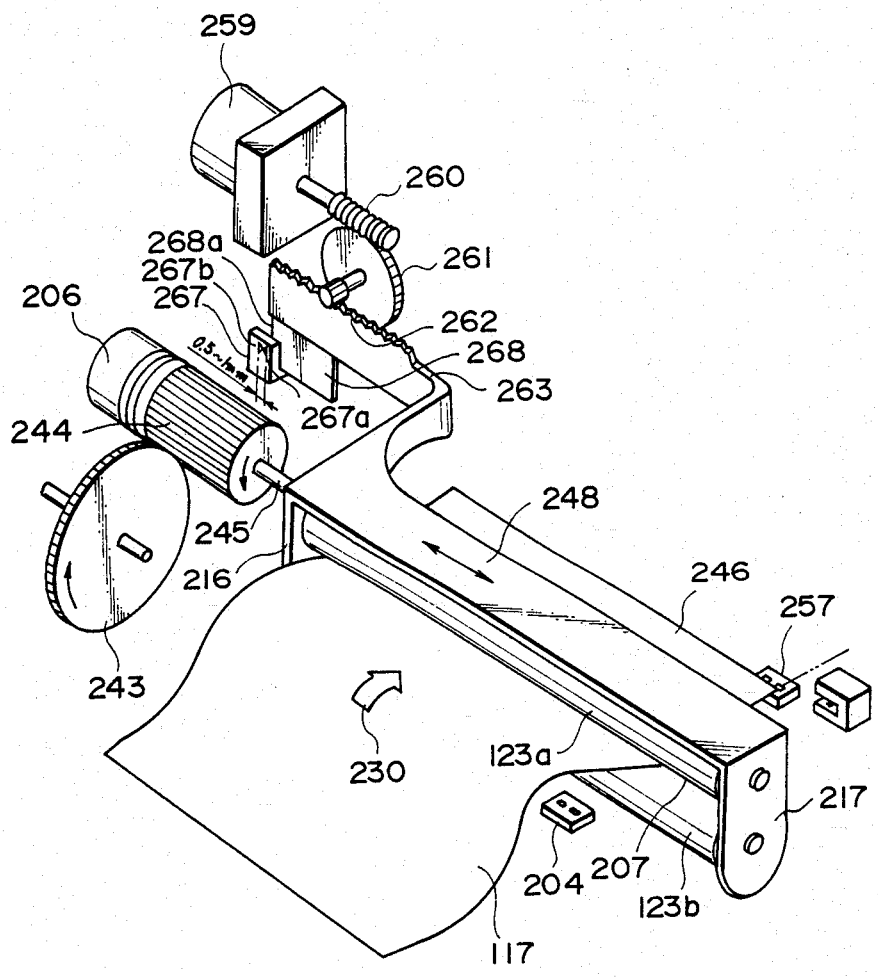
FIG. 12 is a perspective view of another driving mechanism for the registration roller couple.

FIG. 12 shows another embodiment for displacing the registration rollers 123*a* and 123*b* in the lateral direction. In this embodiment, when the motor 259 rotates, the driving force is transmitted to the rack 261 meshed with a gear 260 to rotate a pinion 262 which is integral with the gear 261. As a result, the rack 263 moves in the direction perpendicular to the transfer sheet transportation. A sensor 267 is constituted by detecting portions 267*a* and 267*b*. A sensor 268 which is integral with the rack 263 and has a leading end 268*a*. It is effective to control the sensor 267 to detect the home position.

Figure 13:
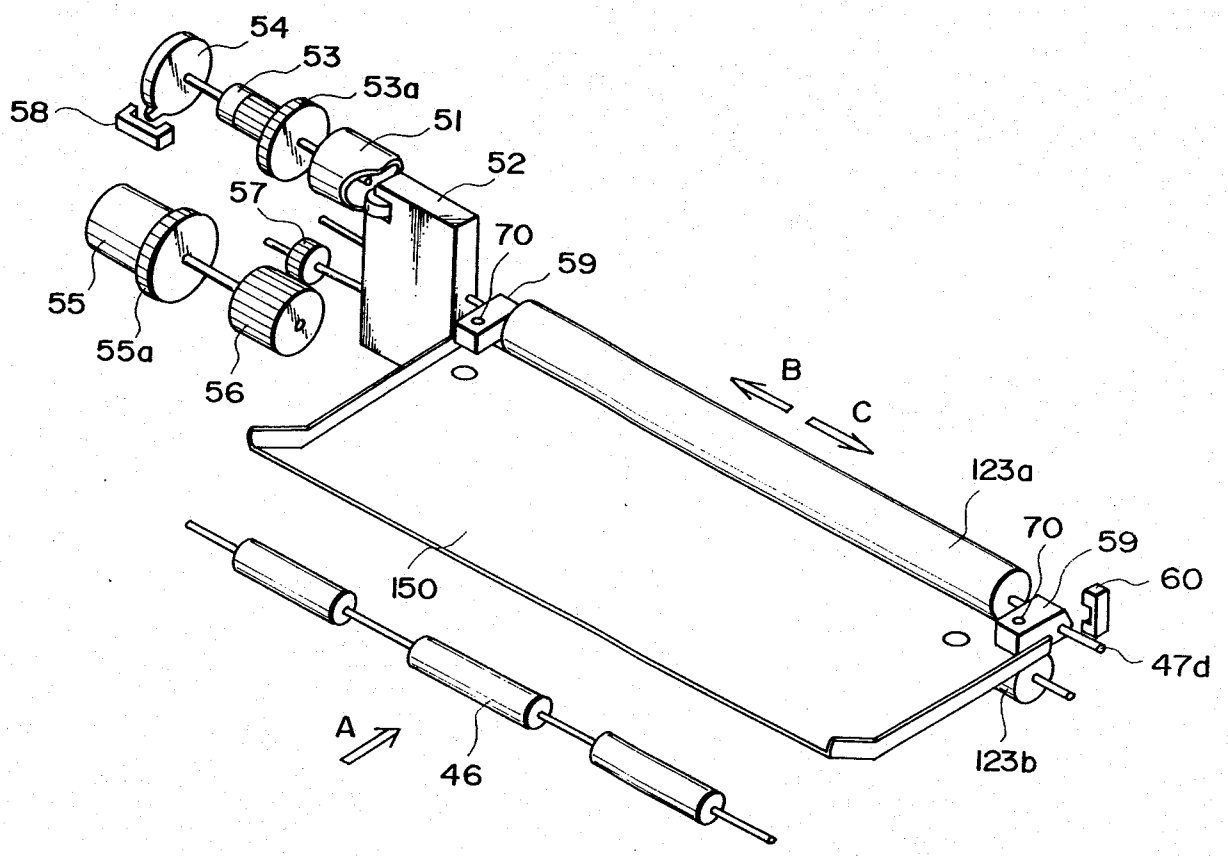
FIG. 13 is a perspective view according to the FIG. 10 embodiment.

FIG. 13 is a perspective view of a further embodiment of the present invention. In this embodiment, the registration rollers 123*a* and 123*b* of FIG. 10 and the top guide plate 150 of FIG. 3 are used in combination. Therefore, the structure and operation of the registration rollers 123*a* and 123*b* are the same as those described in conjunction with FIGS. 10, 11 and 12, and the structure and operation of the top guide plate 150 and the structure and operation in connection with the lateral registration driving mechanism are the same as those of FIG. 3. Therefore, detailed explanation is omitted.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image forming station for forming an image on a sheet;

a rotatable member for transferring the sheet in a first direction toward said image forming station;

supporting means for supporting said rotatable member for displacement in a second direction which traverses the first direction;

driving means for displacing said rotatable member in the second direction to correct deviation of the sheet in the second direction; and inlet guiding means for guiding the sheet to said rotatable member, said guiding means being displaceable in the second direction together with said rotatable member, wherein said rotatable member is disposed upstream of said image forming station with respect to transportation of the sheet and functions also as a registration roller to control timing of sheet transportation to said image forming station.

2. An apparatus according to claim 1, wherein said inlet guiding means constitute a sheet guiding space which becomes narrower toward said rotatable member.

3. An image forming apparatus, comprising:

an image forming station for forming an image on a sheet;

a rotatable member for transferring the sheet in a first direction toward said image forming station;

supporting means for supporting said rotatable member for displacement in a second direction which traverses the first direction;

driving means for displacing said rotatable member in the second direction to correct deviation of the sheet in the second direction; and inlet guiding means for guiding the sheet to said rotatable member, said guiding means being displaceable in said second direction together with said rotatable member and movable to open a sheet passage constituted thereby, wherein said rotatable member is movable in a third direction to open the sheet passage defined in association with rotation of said inlet guiding means.

4. An image forming apparatus, comprising:

an image forming station for forming an image on a sheet;

a rotatable member for transferring the sheet in a first direction toward said image forming station;

supporting means for supporting said rotatable member for displacement in a second direction which traverses the first direction;

driving means for displacing said rotatable member in the second direction to correct deviation of the sheet in the second direction; and inlet guiding means for guiding the sheet to said rotatable member, said guiding means being displaceable in said second direction together with said rotatable member and movable to open a sheet passage constituted thereby, wherein said inlet guiding means is rotatable about an axis of said rotatable member.

5. An image forming apparatus, comprising:

an image forming station for forming an image on a sheet;

a rotatable member for transferring the sheet in a first direction toward said image forming station;

supporting means for supporting said rotatable member for displacement in a second direction which traverses the first direction;

driving means for displacing said rotatable member in the second direction to correct deviation of the sheet in the second direction; and inlet guiding means for guiding the sheet to said rotatable member, said guiding means being displaceable in the second direction together with said rotatable member and movable to open a sheet passage constituted thereby, wherein said inlet guide means is rotatable about a shaft supported on a frame of said image forming apparatus.

6. An image forming apparatus, comprising:

an image forming station for forming an image on a sheet;

a registration roller, disposed upstream of said image forming station with respect to transportation of the sheet, for feeding the sheet in a timed relation with an image formed on an image bearing member of said image forming station so as to align the sheet with the image;

supporting means for supporting said registration roller for displacement in a direction which crosses a direction of the transportation of the sheet; and driving means for displacing said registration roller in the crossing direction to correct deviation of the sheet in the crossing direction.

7. An apparatus according to claim 6, further comprising a feeding passage for feeding the sheet to said registration roller, a refeeding passage for refeeding the sheet on which the image has been formed after being fed by said feeding passage, toward said image forming station, wherein said registration roller is effective to align the refed sheet in the direction of sheet transportation and also in the crossing direction.

* * * * *

UNITED STATES PATENT AND TRADEMARK OFFICE

CERTIFICATE OF CORRECTION

PATENT NO. : 4,823,159

DATED : April 18, 1989

INVENTOR(S) : YASUYOSHI YAMAMOTO, ET AL.

It is certified that error appears in the above-identified patent and that said Letters Patent is hereby corrected as shown below:

COLUMN 1, line 55, "as" should read --is--.

COLUMN 4, line 18, "flap" should read --flapper--;

line 40, "38" should read --37--;

line 45, "then to" should read --then fed to--.

COLUMN 6, line 12, "moved" should read --remove--.

COLUMN 9, line 38, "rack" should read --gear--;

line 43, "which" should be deleted.

Signed and Sealed this

Seventh Day of November, 1989

*Attest:*

JEFFREY M. SAMUELS

*Attesting Officer*

*Acting Commissioner of Patents and Trademarks*